US010941360B2

(12) United States Patent
Raja et al.

(10) Patent No.: US 10,941,360 B2
(45) Date of Patent: Mar. 9, 2021

(54) PROCESS FOR CONVERSION OF HYDROCARBONS

(71) Applicant: HINDUSTAN PETROLEUM CORPORATION LIMITED, Mumbai (IN)

(72) Inventors: Kanuparthy Naga Raja, Hoskote Bangalore (IN); Pudi Satyanarayana Murty, Hoskote Bangalore (IN); Bhavesh Sharma, Hoskote Bangalore (IN); Peddy Ventaka Chalapathi Rao, Hoskote Bangalore (IN); Nettem Venkateswarlu Choudary, Hoskote Bangalore (IN); Sriganesh Gandham, Hoskote Bangalore (IN)

(73) Assignee: Hindustan Petroleum Corporation Limited, Mumbai (IN)

( * ) Notice: Subject to any disclaimer, the term of this patent is extended or adjusted under 35 U.S.C. 154(b) by 0 days.

(21) Appl. No.: 16/334,489

(22) PCT Filed: Sep. 20, 2017

(86) PCT No.: PCT/IB2017/055689
§ 371 (c)(1),
(2) Date: Mar. 19, 2019

(87) PCT Pub. No.: WO2018/055519
PCT Pub. Date: Mar. 29, 2018

(65) Prior Publication Data

US 2019/0211277 A1 Jul. 11, 2019

(30) Foreign Application Priority Data

Sep. 21, 2016 (IN) ..... 201621032242

(51) Int. Cl.
*C10G 69/10* (2006.01)
*C10G 65/12* (2006.01)
(Continued)

(52) U.S. Cl.
CPC ..... *C10G 69/10* (2013.01); *C10G 1/002* (2013.01); *C10G 47/00* (2013.01); *C10G 47/02* (2013.01);
(Continued)

(58) Field of Classification Search
None
See application file for complete search history.

(56) References Cited

U.S. PATENT DOCUMENTS 5,624,547 A 4/1997 Sudhakar et al.
8,303,802 B2 * 11/2012 Lott ..... B01J 8/226 208/108

FOREIGN PATENT DOCUMENTS

| | | |
|---|---|---|
| WO | 2008014150 | 1/2008 |
| WO | 2012163850 | 12/2012 |
| WO | 2015000843 | 1/2015 |

OTHER PUBLICATIONS

Parkash, S, Refining Processes Handbook, 2003, Elsevier Pub., pp. 95-108 (Year: 2003).*

* cited by examiner

*Primary Examiner* — Derek N Mueller
(74) *Attorney, Agent, or Firm* — Sand, Sebolt & Wernow Co., LPA

(57) ABSTRACT

The present disclosure relates to conversion of hydrocarbons. A hydrocarbon feed is hydroprocessed wherein it is hydrocracked in the presence of a catalyst to obtain different hydrocarbon products, which can be suitably processed further to obtain valuable hydrocarbon products.

5 Claims, 1 Drawing Sheet

(51) Int. Cl.

| | |
|---|---|
| ***C10G 69/04*** | (2006.01) |
| ***C10G 69/06*** | (2006.01) |
| ***C10G 69/12*** | (2006.01) |
| ***C10G 47/00*** | (2006.01) |
| ***C10G 47/02*** | (2006.01) |
| ***C10G 1/00*** | (2006.01) |
| ***C10G 65/10*** | (2006.01) |
| ***C10G 67/02*** | (2006.01) |

(52) U.S. Cl.

CPC ..... *C10G 65/10* (2013.01); *C10G 65/12* (2013.01); *C10G 67/02* (2013.01); *C10G 69/04* (2013.01); *C10G 69/06* (2013.01); *C10G 69/123* (2013.01); *C10G 2300/1033* (2013.01); *C10G 2300/301* (2013.01)

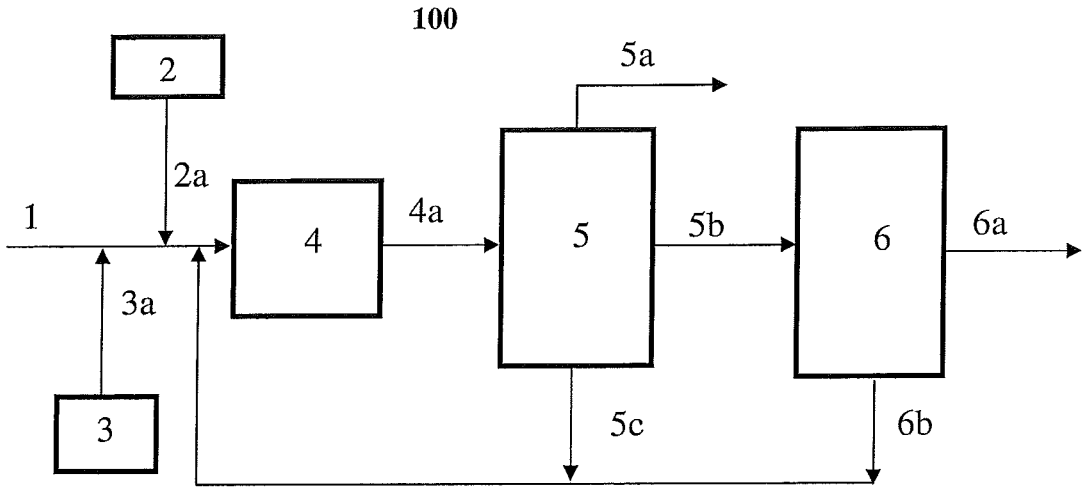
100
2
2a
1
4
4a
5
5a
5b
6
6a
3a
3
5c
6b

PROCESS FOR CONVERSION OF HYDROCARBONS

FIELD

The present disclosure relates to conversion of hydrocarbons.

DEFINITIONS

As used in the present disclosure, the following terms are generally intended to have the meaning as set forth below, except to the extent that the context in which they are used indicate otherwise.

Hydroprocessing: Hydroprocessing, in the present disclosure, includes at least one procedure selected from hydrotreating and hydrocracking.

SIMDIST: SIMDIST refers to simulated distillation which is a gas chromatography (GC) based method for the characterization of petroleum products.

ASTM D-7169: ASTM D-7169 is a test that determines the boiling point distribution and cut point intervals of the crude oil and residues using high temperature gas chromatography.

Bombay High crude oil: Bombay High crude oil is an offshore oilfield off the coast of Mumbai, India Arab extra light crude oil: Arab extra light crude oil is produced from the on-shore fields such as Abqaq and Berri

BACKGROUND

Conventionally, in petroleum refineries, distillation units are used for transforming crude oil into valuable fuel products having different boiling fractions. These straight run products are separated and treated by using different processes in order to meet the product quality that can be marketed. In the conventional process, the conversion of crude oil can be increased by increasing the number of process units such as distillation columns. However, this increases the complexity of the entire process.

The global demand for distillates is growing exponentially. In order to maximize the yield of such distillates, hydrocracking process is used to convert heavy hydrocarbons into more valuable distillates under hydrogen atmosphere. Hydro-processing or hydrocracking is particularly carried out at the downstream of process units such as distillation columns, after crude oil is separated into straight run products. In hydro-processing, hydrocarbons including naphtha, gas oils, and cycle oils are treated to remove sulfur and nitrogen content from the hydrocarbons or reformed to obtain light hydrocarbons with increased octane number.

Conventionally, in refineries, crude oil is separated into various fractions and the fractions are individually processed in separate hydro-processing units, thereby increasing the consumption of energy and making the entire process non-economical. Moreover, due to the stringent environmental norms, focus is given to hydro-processing technologies so as to obtain products with reduced consumption of energy.

There is, therefore, felt a need for a process that increases the yield of valuable petroleum fractions.

OBJECTS

Some of the objects of the present disclosure, which at least one embodiment herein satisfies, are as follows:

It is an object of the present disclosure to ameliorate one or more problems of the prior art or to at least provide a useful alternative.

An object of the present disclosure is to provide a process for conversion of hydrocarbons.

Another object of the present disclosure is to provide a process for conversion of hydrocarbons that produces high quality hydrocarbon products with increased yield of light hydrocarbons.

Other objects and advantages of the present disclosure will be more apparent from the following description, which is not intended to limit the scope of the present disclosure.

SUMMARY

The present disclosure envisages a process conversion of hydrocarbons. The process of the present disclosure comprises mixing a hydrocarbon feed, hydrogen and a catalyst to obtained a combined feed. The combined feed is preheated to obtain a preheated feed. The preheated feed is introduced into a hydrocracker and hydrocracked at a temperature in the range of 300° C. to 500° C., preferably at 320 to 480° C. and at a pressure in the range of 2 to 80 bar, preferably in the range of 15 bar to 50 bar to obtain a hydrocracked stream. The hydrocracked stream is transferred from the hydrocracker to a fractionator to obtain a top fraction having boiling point less than 180° C., a middle fraction having boiling point in the range of 180° C. to 370° C. and a bottom fraction having boiling point greater than 370° C. The middle fraction along with a portion of bottom fraction is processed in a processing unit such as isomerization unit, reforming unit, alkylation unit, hydrotreating unit, hydrocracking unit, atmospheric distillation unit, vacuum distillation unit, fluid catalytic cracking unit, delayed coker, visbreaker etc to obtain a light fraction having boiling point less than 370° C. and a heavy fraction having boiling point greater than 370° C. A portion of the bottom fraction is recycled to the hydrocracker.

The hydrocarbon feed comprises at least one feed selected from the group consisting of crude oil, tar sands, bituminous oil, oil sands bitumen, tight oil and shale oil.

The catalyst of the present disclosure comprises at least one metal or a metallic compound of the metal selected from the group consisting of chromium, manganese, iron, cobalt, nickel, zirconium, niobium, molybdenum, tungsten, ruthenium, rhodium, tin and tantalum.

The amount of the catalyst is in the range of 0.001 wt % to 10 wt % of the hydrocarbon feed.

The process step of hydrocracking can be carried out for a time period in the range of 15 minutes to 3 hours in the hydrocracker.

The downstream processing unit of the present disclosure is at least one selected from the group consisting of isomerization unit, reforming unit, alkylation unit, hydrotreating unit, hydrocracking unit, atmospheric distillation unit, vacuum distillation unit, fluid catalytic cracking unit, delayed coker and visbreaker.

BRIEF DESCRIPTION OF ACCOMPANYING DRAWING

The present disclosure will now be described with the help of the accompanying drawing in which:

FIG. 1 is a schematic representation of a system, used for performing the process of the present disclosure.

| REFERENCE NUMBER | ELEMENTS |
|---|---|
| 1 | Hydrocarbon feed |
| 2 | Catalyst stock |
| 2a | Catalyst |
| 3 | Hydrogen stock |
| 3a | Hydrogen |
| 4 | Hydrocracker |
| 4a | hydrocracked stream |
| 5 | Fractionator |
| 5a | Top Fraction |
| 5b | Middle Fraction |
| 5c | Bottom Fraction |
| 6 | Processing unit |
| 6a | Light Fraction |
| 6b | Heavy fraction |

DETAILED DESCRIPTION

Conventionally, crude oil is separated into individual fractions, which are then separately processed in individual hydroprocessing units. This makes the refinery complicated and involves huge expenditure to hydroprocess each individual fraction obtained from the crude oil.

The present disclosure, therefore, envisages a process for conversion of hydrocarbons that is both efficient and economical.

In accordance with an aspect of the present disclosure, there is provided a process for conversion of hydrocarbons. The process comprises the following steps:

Initially, a hydrocarbon feed, is mixed with hydrogen and a catalyst in a mixer to obtain a combined feed. The combined feed is preheated in a preheater to obtain a preheated feed. The temperature of the preheated feed is maintained at a temperature below 350° C.

Next, the preheated feed is introduced into a hydrocracker, wherein the preheated feed is hydrocracked under inert atmosphere at a temperature in the range of 300° C. to 500° C., preferably in the range of 320° C. to 480° C. and at a pressure in the range of 2 to 80 bar, preferably in the range of 15 bar to 50 bar to obtain a hydrocracked stream. The process step of hydrocracking is carried out for a time period in the range of 15 minutes to 3 hours.

In accordance with an embodiment of the present disclosure, silicone based antifoaming agents like polydimethylsiloxanes, corrosion inhibitors, bio-surfactants and surfactants based on sulphonic acids, can be added to the hydrocarbon feed before introducing it into the hydrocracker.

After hydrocracking, the hydrocracked stream obtained in the hydrocracker is sent to a fractionator to separate the hydrocracked stream into fractions to obtain a top fraction having boiling point less than 180° C., a middle fraction having boiling point in the range of 180° C. to 370° C. and a bottom fraction having boiling point greater than 370° C.

In accordance with one embodiment of the present disclosure, the top fraction comprises hydrogen which is recycled to the hydrocracker after treatment and purification.

In accordance with the embodiments of the present disclosure, a portion of the bottom fraction is recycled to the hydrocracker.

The middle fraction along with a portion of bottom fraction is fed to a downstream processing step, wherein it is further treated to obtain distillates having a light fraction having boiling point less than 370° C. and heavy fraction having a boiling point greater than 370° C.

In accordance with the embodiments of the present disclosure, a portion of the heavy fraction is recycled to the hydrocracker.

In accordance with the embodiments of the present disclosure, the hydrocarbon feed comprises at least one feed selected from the group consisting of crude oil, tar sand, bituminous oil, oil sands bitumen, tight oil, and shale oil. The degree API gravity of the hydrocarbon feed is in the range of 7 to 50, preferably in the range of 10 to 40. The sulphur content of the hydrocarbon feed is in the range of 0.05 to 5 wt %, preferably in the range of 0.1 to 3.5 wt %. The nitrogen content of the hydrocarbon feed is in the range of 0.1-1 wt %, preferably in the range of 0.2 to 0.5 wt %. TAN of the hydrocarbon feed is in the range of 0.01 to 0.1 mgKOH/g, preferably in the range of 0.12 to 0.5 mgKOH/g. The water content of the hydrocarbon feed is less than 1.5 wt %, preferably less than 0.1 wt %. The the CCR of the hydrocarbon feed is in the range of 1 to 30%, preferably in the range of 1 to 20 wt %.

In accordance with the embodiments of the present disclosure, the catalyst can be colloidal dispersed or slurry phase dispersed catalyst or oil soluble catalyst or hydroprocessing catalyst. The catalyst comprises at least one metal or metallic compounds of a metal selected from the group consisting of chromium, manganese, iron, cobalt, nickel, zirconium, niobium, molybdenum, tungsten, ruthenium, rhodium, tin and tantalum.

In accordance with the embodiments of the present disclosure, the downstream processing is carried out in at least one unit selected from the group comprising of isomerization unit, reforming unit, alkylation unit, hydrotreating unit, hydrocracking unit, atmospheric distillation unit, vacuum distillation unit, fluid catalytic cracking unit, delayed coker and visbreaker.

In accordance with the embodiments of the present disclosure, the hydrocarbon feed is hydrocracked to at least substantial degree and simultaneously hydrotreated in the presence of a catalyst to obtain different hydrocarbon products, which can be suitably processed further to obtain valuable hydrocarbon products.

The process of the present disclosure can be performed using a system represented by FIG. 1.

A heavy hydrocarbon feed 1, of which the non-limiting examples include crude oil, tar sands, bituminous oil, oil sands bitumen, and shale oil is mixed with hydrogen 3*a* received from a hydrogen stock 3 and a catalyst 2*a* received from a catalyst stock 2 to obtain a combined feed. The so obtained combined feed is then received by a hydrocracker 4 where the heavy hydrocarbon feed 1 is subjected to the process of hydrocracking. The combined feed is preheated in a preheater (not shown in the FIGURE) to obtain a preheated feed, which is then hydrocracked. In an embodiment, the hydrocracking can be carried out at a temperature in the range of 300° C. to 500° C., preferably in the range of 320° C. to 480° C. and at a pressure in the range of 2 to 80 bar, preferably in the range of 15 bar to 50 bar to obtain a hydrocracked stream (4*a*).

In one embodiment, the hydrocracker 4 can be selected from the group consisting of continuous stirred tank reactors, fixed bed reactors, ebullated bed reactor, slurry bubble column reactor or combinations thereof. Other reactors are also envisaged.

The catalyst employed can be in various forms, the non-limiting examples of which are colloidally dispersed, slurry form, and oil soluble. Non-limiting examples of the catalyst include at least one metal or compound of a metal selected from the group consisting of chromium, manganese, iron, cobalt, nickel, zirconium, niobium, molybdenum, tungsten, ruthenium, rhodium, tin, and tantalum. Other hydroprocessing catalysts are also envisaged.

Typically, the amount of the catalyst can be in the range of 0.001 wt % to 10 wt % of the hydrocarbon feed.

In the hydrocracker 4, the heavy hydrocarbon feed 1 is subjected to hydrocracking at least to a substantial degree to obtain lighter hydrocarbon products while simultaneously hydrotreating the heavy hydrocarbon feed 1 and the lighter hydrocarbon products. By way of hydrotreating, the hydrocarbons (the heavy hydrocarbon feed 1 and the lighter hydrocarbon products) are subjected to desulphurization, demetallization, denitrogenation and removal of any other contaminants.

The product stream 4*a* from the hydrocracker 4 is then received in a fractionator 5 to segregate the individual product fractions—5*a*, 5*b* and 5*c*. In an embodiment, the fractionator 5 can be an atmospheric fractionation column. The product fractions are separated based on their boiling ranges. The product fraction 5*a* can comprise dry gas, LPG and naphtha, 5*b* can comprise kerosene and diesel, while the product fraction 5*c* can comprise gas oils and atmospheric bottoms.

The dry gas from product fraction 5*a* can be further treated to separate the contaminants from LPG and hydrogen. The hydrogen can be recycled back into the hydrocracker 4 after separating from LPG and further purification.

The product stream 5*b* comprising various distillate products along with a portion of 5*c* (not shown in the diagram) may be further sent to a processing unit 6, the non-limiting examples of which are typical units in a conventional refinery such as atmospheric distillation unit, vacuum distillation unit, isomerization unit, reforming unit, alkylation unit, hydrotreating unit, hydrocracking unit, fluid catalytic cracking unit, visbreaker, and delayed coker for further conversion and treatment of the products.

The portion of product stream 5*c* comprising atmospheric bottoms with boiling points over 370° C. can be recycled back to the hydrocracker 4. The hydrogen produced can be separated from the top fraction and can be recycled to hydrocracker after purification.

From the downstream processing unit 6, the product stream 6*a* can be sent to blending and storage tanks. The heavier portion 6*b* comprising heavy boiling fractions with boiling points over 370° C. can be recycled back to the hydrocracker 4.

The present disclosure is further described in the light of the following laboratory experiments, which are set forth for illustration purpose only, and not to be construed as limiting the scope of the disclosure. The following experiment can be scaled up to industrial/commercial scale, and the results obtained can be extrapolated to industrial scale.

EXPERIMENTS

Experiment 1: Hydrocracking of Crude Oil (Bombay High Crude Oil)

An experimental hydrocracker was charged with 100 g of crude oil and catalyst slurry containing 3000 ppm molybdenum. The experimental hydrocracker was purged with nitrogen to remove any air present inside and pressurized with hydrogen to 15 bar pressure to obtain a combined feed. The combined feed was preheated to obtain a preheated feed.

The preheated feed contained in the experimental hydrocracker was heated to 420° C. under continuous stirring with a stirring speed of 1000 rpm.

Hydrocracking of the crude oil initiated in the presence of hydrogen, as the temperature rose above 350° C. Heating was continued while maintaining the temperature at 420° C. for 20 minutes to obtain a hydrocracked stream. The hydrocracked stream was cooled to a temperature below 30° C. The hydrocracked were sent to an experimental fractionator as per ASTM D86 where various fractions were separated according to the boiling points, a top fraction (<180° C.), a middle fraction (180° C. to 370° C.) and a bottom fraction (>370° C.). The gaseous and liquid products from the experimental fractionator were collected separately and were analyzed using GC-SIMDIST as per ASTM D-7169.

Table 1 presents a comparison of the yields of different fractions of the products obtained from the hydrocracker.

TABLE 1

Yields of different fractions of hydrocracked crude oil

| Fractions obtained | Feed (Bombay high Crude oil fractions yield) wt % | Product (Bombay high hydrocracked crude oil fractions yield), wt % | Difference in yield, wt % |
|---|---|---|---|
| <180° C. | 24.6% | 27.00% | +2.4% |
| 180° C. to 370° C. | 37.7% | 42.41% | +5.11% |
| >370° C. | 37.7% | 28.99% | −8.18% |

The middle fraction along with a portion of bottom fraction was further sent for hydrocracking to obtain a light fraction and a heavy fraction, thereby increasing the overall yield of light distillates. The heavy fraction was recycled to the hydrocracker.

It is observed that the hydrocracked crude oil resulted in a higher yield of the top and middle fraction, reducing the yields of the bottom fractions. The difference in the yields shows an enhancement in the yield of overall distillates by 8.18 wt % by converting the heavier hydrocarbons.

Experiment 2: Hydrocracking of Crude Oil (Arab Extra Light Crude)

An experimental hydrocracker was charged with 100 g of crude oil and a catalyst slurry containing 3000 ppm molybdenum. The experimental hydrocracker was purged with nitrogen to remove any air present inside and pressurized with hydrogen to 15 bar to obtain a combined feed. The combined feed was preheated to obtain a preheated feed.

The preheated feed contained in the experimental hydrocracker was heated to 420° C. under continuous stirring with a stirring speed of 1000 rpm.

Hydrocracking of the crude oil initiated in the presence of hydrogen, as the temperature rose above 350° C. Heating was continued while maintaining the temperature at 420° C. for 20 minutes to obtain a hydrocracked stream. The hydrocracked gaseous products were analyzed using Refinery Gas Analyzer and liquid products were analyzed using GC-SIMDIST as per ASTM D-7169 to measure the various cut points, a top fraction (<180° C.), a middle fraction (180° C. to 370° C.) and a bottom fraction (>370° C.).

Further the individual product cuts were separated using ASTM D86 and the results are given in Table 2.

Table 2 presents a comparison of the yields of different fractions of the products obtained from the hydrocracker.

TABLE 2

Yields of different fractions of hydrocracked crude oil

| Fractions obtained | Feed (Arab extra light Crude oil fractions yield) wt % | Product (Arab extra light hydrocracked crude oil fractions yield), wt % | Difference in yield, wt % |
|---|---|---|---|
| <180° C. | 25.4% | 34.4% | +9% |
| 180° C. to 370° C. | 36.6% | 41.4% | +4.8% |
| >370° C. | 38% | 24.2% | −13.8% |

The middle fraction was further sent for hydrotreating to obtain the treated product with reduced sulfur and nitrogen.

It is observed that the hydrocracked crude oil resulted in a higher yield of the top and middle fraction, reducing the yields of the heavier fractions. The difference in the yields shows an enhancement in the yield of overall distillates by 13.8 wt % by converting the heavier hydrocarbons.

The experimental results can be extrapolated for pilot scale and/or industrial scale for the disclosed Process.

TECHNICAL ADVANCEMENTS

The present disclosure described herein above has several technical advantages including, but not limited to, the realization of a process for conversion of hydrocarbons that is economical and efficient; and produces higher percentage of light hydrocarbon products.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the invention to achieve one or more of the desired objects or results. While certain embodiments of the inventions have been described, these embodiments have been presented by way of example only, and are not intended to limit the scope of the inventions. Variations or modifications to the formulation of this invention, within the scope of the invention, may occur to those skilled in the art upon reviewing the disclosure herein. Such variations or modifications are well within the spirit of this invention.

The numerical values given for various physical parameters, dimensions and quantities are only approximate values and it is envisaged that the values higher than the numerical value assigned to the physical parameters, dimensions and quantities fall within the scope of the invention unless there is a statement in the specification to the contrary.

While considerable emphasis has been placed herein on the specific features of the preferred embodiment, it will be appreciated that many additional features can be added and that many changes can be made in the preferred embodiment without departing from the principles of the disclosure. These and other changes in the preferred embodiment of the disclosure will be apparent to those skilled in the art from the disclosure herein, whereby it is to be distinctly understood that the foregoing descriptive matter is to be interpreted merely as illustrative of the disclosure and not as a limitation.

The invention claimed is:

1. A process for conversion of hydrocarbons, said process comprising the following steps:

i. mixing crude oil containing 10% by volume hydrocarbons with a distillation point of less than 200° C., hydrogen and a catalyst in a mixer to obtain a combined feed;

ii. preheating said combined feed in a preheater to obtain a preheated feed;

iii. hydrocracking said preheated feed under hydrogen atmosphere in a hydrocracker at a temperature in the range of 300° C. to 500° C., and at a pressure in the range of 2 bar to 30 bar to obtain a hydrocracked stream; wherein, said hydrocracking is carried out for a time period in a range of 15 minutes to 4 hours;

iv. fractionating said hydrocracked stream to separate into fractions including a top fraction, a middle fraction and a bottom fraction;

v. recycling at least a portion of said bottom fraction to said hydrocracker of step (iii);

vi. processing said middle fraction and another portion of said bottom fraction to obtain a light fraction and a heavy fraction; and vii. recycling said heavy fraction to said hydrocracker of step (iii).

2. The process as claimed in claim 1, wherein said catalyst comprises at least one metal or a metallic compound of said metal selected from the group consisting of chromium, manganese, iron, cobalt, nickel, zirconium, niobium, molybdenum, tungsten, ruthenium, rhodium, tin, and tantalum.

3. The process as claimed in claim 1, wherein said top fraction comprises hydrocarbons having boiling point less than 180° C., middle fraction comprises hydrocarbons having boiling point in the range of 180° C. to 370° C. and the bottom fraction comprises hydrocarbons having boiling point greater than 370° C.

4. The process as claimed in claim 1, wherein the amount of said catalyst added in step (i) is in the range of 0.001 wt % to 10 wt % of said hydrocarbon feed.

5. The process as claimed in claim 1, wherein said processing is carried out in at least one unit selected from the group consisting of atmospheric distillation unit, vacuum distillation unit, isomerization unit, reforming unit, alkylation unit, hydrotreating unit, hydrocracking unit, fluid catalytic cracking unit, visbreaker, and delayed coker.

* * * * *